US008081791B2

(12) United States Patent
Funahashi

(10) Patent No.: US 8,081,791 B2
(45) **Date of Patent: *Dec. 20, 2011**

(54) LOUDSPEAKER

(75) Inventor: Osamu Funahashi, Mie (JP)

(73) Assignee: Panasonic Corporation, Osaka (JP)

( * ) Notice: Subject to any disclaimer, the term of this patent is extended or adjusted under 35 U.S.C. 154(b) by 1203 days.

This patent is subject to a terminal disclaimer.

(21) Appl. No.: 11/794,664

(22) PCT Filed: Jan. 16, 2007

(86) PCT No.: PCT/JP2007/050455

§ 371 (c)(1),
(2), (4) Date: Jul. 3, 2007

(87) PCT Pub. No.: WO2007/083607

PCT Pub. Date: Jul. 26, 2007

(65) Prior Publication Data

US 2008/0212821 A1 Sep. 4, 2008

(30) Foreign Application Priority Data

Jan. 17, 2006 (JP) ..... 2006-008444

(51) Int. Cl.
*H04R 1/00* (2006.01)

(52) U.S. Cl. ..... 381/404; 381/430; 381/410; 381/409; 381/407; 381/405; 381/400; 381/398; 381/396; 381/361; 181/171; 181/172; 29/594; 29/609.1

(58) Field of Classification Search ..... None
See application file for complete search history.

(56) References Cited

U.S. PATENT DOCUMENTS

| | | | | |
|---|---|---|---|---|
| 5,715,324 | A | 2/1998 | Tanabe et al. | |
| 2005/0175212 | A1* | 8/2005 | Murayama et al. | 381/407 |
| 2009/0123019 | A1* | 5/2009 | Funahashi | 381/413 |

FOREIGN PATENT DOCUMENTS

| | | |
|---|---|---|
| DE | 1 001 326 | 1/1957 |

(Continued)

OTHER PUBLICATIONS

European Search Report issued in European Patent Application No. 07706789.0-2225, mailed Mar. 17, 2011.

*Primary Examiner* — Charles Garber
*Assistant Examiner* — Yasser Abdelaziez
(74) *Attorney, Agent, or Firm* — McDermott Will & Emery LLP

(57) ABSTRACT

A loudspeaker includes a frame, a magnetic circuit supported by the frame, voice coil body provided movably in relation to a magnetic gap provided at the magnetic circuit, a diaphragm having an outer rim being joined via a first edge to the frame and an inner rim being joined to the voice coil body, and a damper located towards the magnetic circuit from the diaphragm. The damper has an inner rim joined to the voice coil body. The damper has an outer rim joined via a second edge to the frame. The second edge protrudes towards the diaphragm or in a direction opposite to the diaphragm. The damper includes a first protrusion protruding towards the diaphragm and a second protrusion protruding in a direction opposite to a direction in which the first protrusion protrudes. A protrusion out of the first and second protrusions is closest to the second edge among the protrusions. A further projection out of the first and second protrusions is located more inside than the protrusion and protrudes in a direction opposite to a direction in which the second edge protrudes. The further protrusion has a size largest among sizes of other protrusion. This loudspeaker has a small distortion and a large driving efficiency.

7 Claims, 4 Drawing Sheets

FOREIGN PATENT DOCUMENTS

| | | | |
|---|---|---|---|
| JP | 2-133097 | | 11/1990 |
| JP | 2004-007332 | | 1/2004 |
| NL | 8204348 | | 3/1983 |
| WO | WO 03/092324 | A1 | 11/2003 |
| WO | WO 2004/019446 | A2 | 3/2004 |

* cited by examiner

LOUDSPEAKER

RELATED APPLICATIONS

This application is the U.S. National Phase under 35 U.S.C. §371 of International Application No. PCT/JP2007/050455, filed on Jan. 16, 2007 which in turn claims the benefit of Japanese Application No. 2006-008444, filed on Jan. 17, 2006, the disclosures of which Applications are incorporated by reference herein.

TECHNICAL FIELD

The present invention relates to a loudspeaker.

BACKGROUND OF THE INVENTION

FIG. 4 is a cross sectional view of a conventional loudspeaker 501 disclosed in patent document 1. A voice coil 502A is located movably near a magnetic circuit 501A, and is joined to an inner rim of a diaphragm 503A. An outer rim of the diaphragm 503A is joined to an edge 504A joined to a frame 505A. A back side of the diaphragm 503A is joined to a suspension holder 506A. The suspension holder 506A is joined to edge 507A joined to the frame 505A. The edges 504A and 507A protrude in opposite directions so that the vertically vibrating excursion of the diaphragm 503A is equal in both upward and downward directions, hence suppressing distortion of the loudspeaker 501.

The suspension holder 506A is joined to the back side of the diaphragm 503*a*, hence vibrating together with the diaphragm 503A. A vibrating portion including the suspension holder 506A and the diaphragm 503A has a significantly large weight. This weight is not a big issue when the loudspeaker 501 reproducing lower-frequency sound. However, the weight may decline the driving efficiency of the loudspeaker 501 during the reproduction of medium-frequency or higher-frequency sound.

Patent Document 1: JP2004-7332A

SUMMARY OF THE INVENTION

A loudspeaker includes a frame, a magnetic circuit supported by the frame, voice coil body provided movably in relation to a magnetic gap provided at the magnetic circuit, a diaphragm having an outer rim being joined via a first edge to the frame and an inner rim being joined to the voice coil body, and a damper located towards the magnetic circuit from the diaphragm. The damper has an inner rim joined to the voice coil body. The damper has an outer rim joined via a second edge to the frame. The second edge protrudes towards the diaphragm or in a direction opposite to the diaphragm. The damper includes a first protrusion protruding towards the diaphragm and a second protrusion protruding in a direction opposite to a direction in which the first protrusion protrudes. A protrusion out of the first and second protrusions is closest to the second edge among the protrusions. A further projection out of the first and second protrusions is located more inside than the protrusion and protrudes in a direction opposite to a direction in which the second edge protrudes. The further protrusion has a size largest among sizes of other protrusion.

This loudspeaker has a small distortion and a large driving efficiency.

REFERENCE NUMERALS

1 Magnetic Circuit
2 Voice Coil Body
3 Diaphragm
4 Edge (First Edge)
5 Frame
8 Magnetic Gap
10 Damper
11 Edge (Second Edge)
10A Protrusion (First Protrusion)
10B Protrusion (Second Protrusion)
10C Protrusion
10D Protrusion
60 Damper
60A Protrusion
60B Protrusion
60C Protrusion
60D Protrusion
610 Edge (Second Edge)
310 Assembly
320 Joint Portion
360 Assembly
370 Joint Portion

DETAIL DESCRIPTION OF THE PREFERRED EMBODIMENT

Figure 1:
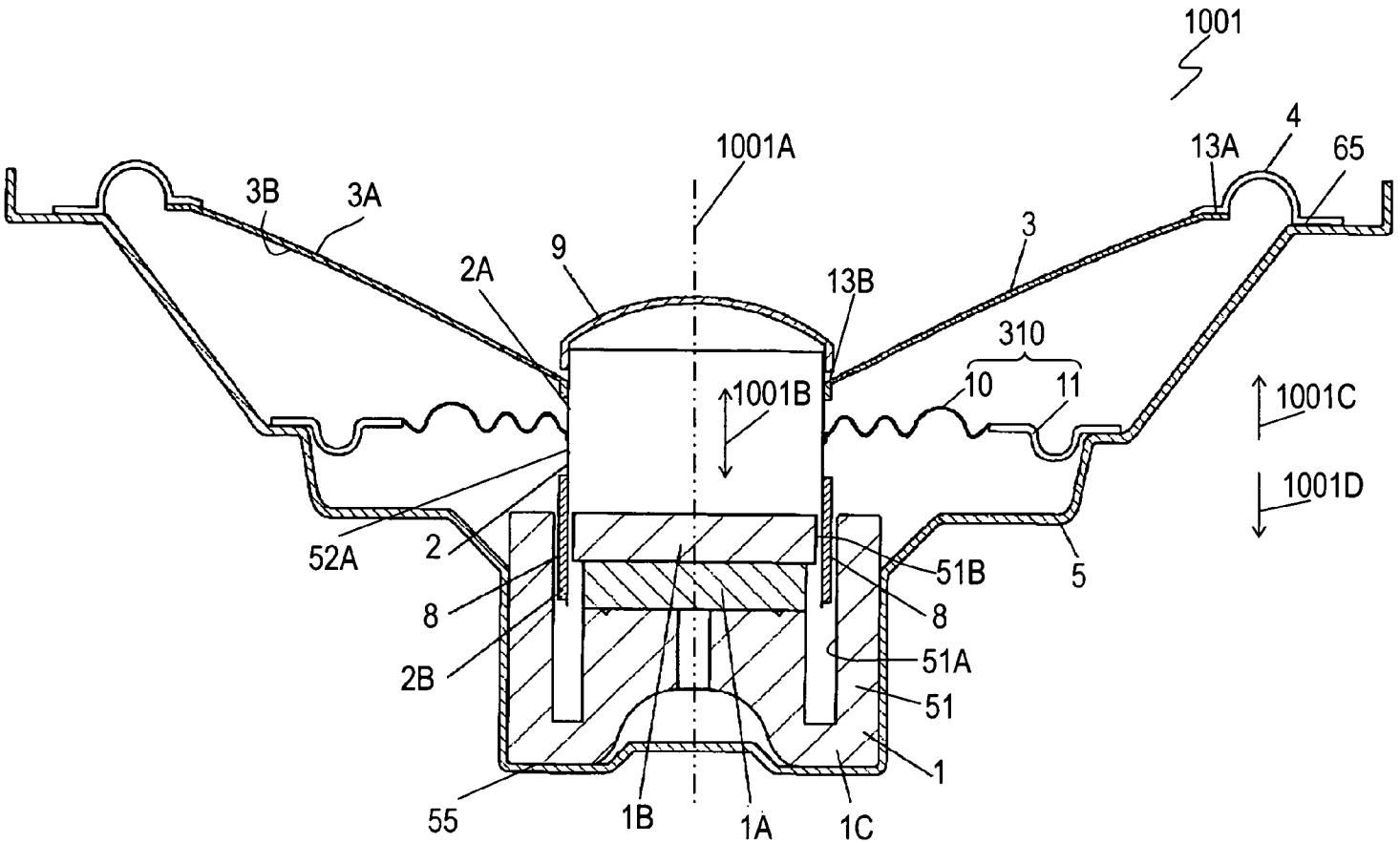
FIG. 1 is a cross sectional view of a loudspeaker according to an exemplary embodiment of the present invention.

FIG. 1 is a cross sectional view of a loudspeaker 1001 according to an exemplary embodiment of the present invention. A magnetic circuit 1 is supported at the center of a bottom 55 of a frame 5 having a bowl shape. The magnetic circuit 1 includes a magnet 1A having a disk shape, a plate 1B having a disk shape, and a yoke 1C having a cylindrical shape which are bonded together. A magnetic gap 8 having a tubular shape is provided between an inner surface 51A of a side wall 51 of the yoke 1C and an outer surface 51B of the plate 1B, and opens towards a diaphragm 3. FIG. 1 illustrates a cross section of the loudspeaker 1001 along a plane which is parallel to a center axis 1001A and which includes the center axis 1001A.

A voice coil body 2 includes a bobbin 2A having a cylindrical shape and extending along the center axis 1001A, and a coil 2B wound about the center axis 1001A on an outer surface 52A of the bobbin 2A. The coil 2B, a part of the voice coil body 2, is located in the magnetic gap 8 and movably in a direction 1001B parallel to the center axis 1001A. The diaphragm 3 has a thin cone shape, and has an inner rim 13*b* joined to the upper portion of the bobbin 2A of the voice coil body 2. Upon receiving an alternating-current (AC) current, the coil 2B vibrates in the direction 1001B in the magnetic gap 8, and accordingly, causes the diaphragm 3 joined to the bobbin 2A to vibrate. The diaphragm 3 has an upper surface 3A and a lower surface 3B opposite to the upper surface 3A. The bobbin 2A extends downwardly from the lower surface 3B of the diaphragm 3. The coil 2B is located beneath the lower surface 3B of the diaphragm 3. The bobbin 2A extends also from the upper surface 3A of the diaphragm 3. A dust cap 9 is provided at an upper end of the bobbin 2A for preventing dust from entering into the bobbin. A damper 10 has an outer rim 210A coupled to the frame 5 via an edge 11.

The diaphragm 3, a sound source, is made essentially of pulp or plastic material, and has a large stiffness and a small internal loss. The diaphragm 3 has an outer rim 13A coupled via an edge 4 to an open end 65 of the frame 5. More specifically, the outer rim 13A of the diaphragm 3 is joined to the edge 4 joined to the open end 65 of the frame 5. The edge 4 protrudes upwardly from the upper surface 3A of the diaphragm 3 in the direction 1001B, i.e., in the direction 1001C. The edge 4 is made of light material, such as foamed urethane, foamed rubber, SBR rubber, or cloth, which provides the diaphragm 3 with a small moving load.

Figure 2:
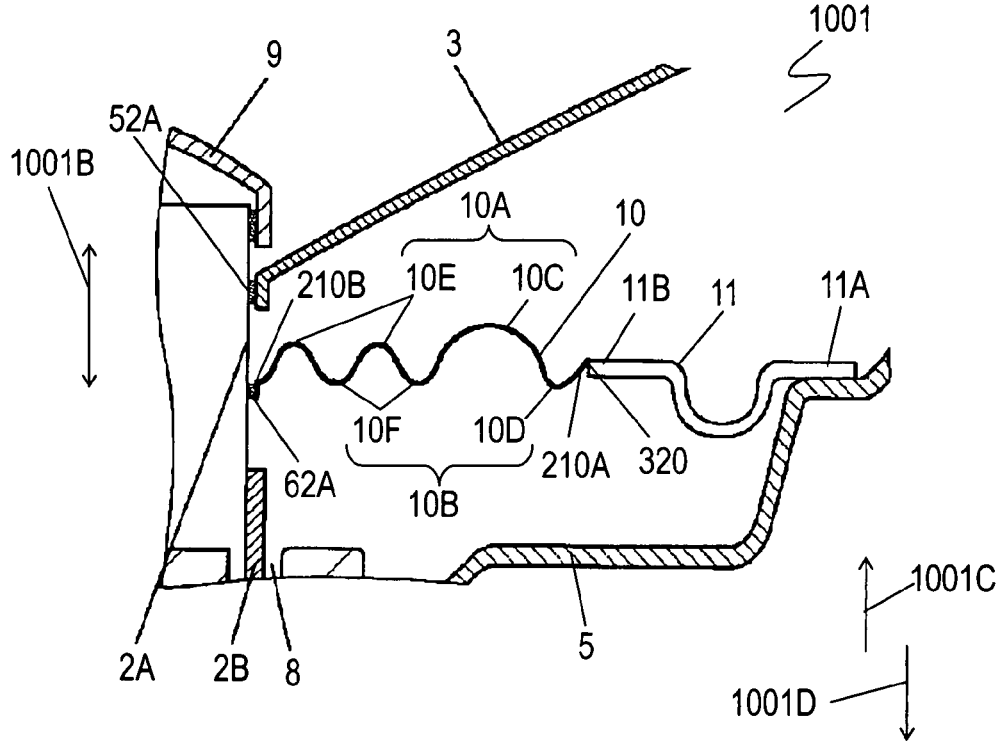
FIG. 2 is an enlarged cross sectional view of the loudspeaker according to the embodiment.

FIG. 2 is an enlarged cross sectional view of the loudspeaker 1001 along the plane which is parallel to the center axis 1001A and which includes the center axis 1001A. The damper 10 has an inner rim 210B joined to a portion 62A of the outer surface 52A of the bobbin 2A of the voice coil body 2. The portion 62A is located from the diaphragm 3 in the direction 1001D from the diaphragm 3 towards the magnetic circuit 1. The outer rim 210A of the damper 10 is joined via the edge 11 to the frame 5. More particularly, the outer rim 210A of the damper 10 is joined to the inner rim 11B of the edge 11, and an outer rim 11A of the edge 11 is joined to the frame 5. The edge 11 is a component different from the damper 10. The damper 10 has a corrugated ring shape corrugating radially from the center axis 1001A, hence expanding and contracting according to the excursion of the bobbin 2A of the voice coil body 2. The damper 10, similarly to the edge 4, is made of light material, such as urethane, foamed rubber, SBR rubber, or cloth, which provides the diaphragm 3 with a small moving load.

Upon the coil 2B having a current of an audio signal, the voice coil body 2 vibrates along the direction 1001B in the magnetic gap 8 and accordingly, causes the diaphragm 3 to vibrate, thus causing the loudspeaker 1001 to output sound of the audio signal. The edge 11 protrudes in the direction 1001D opposite to the direction 1001C in which the edge 4 protrudes. This structure allows the excursion of the vibration of the diaphragm 3 in the direction 1001C to be symmetrical to the excursion of the vibration of the diaphragm in the direction 1001D, thus reducing distortion of the loudspeaker and increasing the driving efficiency of the loudspeaker 1001.

The damper 10 is coupled to the frame 5 and joined to the voice coil body 2 so as to reduce the rolling of the voice coil body 2. The damper 10 having the corrugated ring shape is elastic, hence easily following the vibration of the voice coil body 2.

The damper 10 having the corrugated ring shape does not provide the voice coil body 2 with no significant load while the excursion of the vibration of the voice coil body 2 is relatively small.

In the loudspeaker 1001, the outer rim 210A of the damper 10 is joined via the edge 11 to the frame 5. If the excursion of the vibration of the voice coil body 2 is large, a stress is applied to the edge 11 to have the edge 11 deform elastically. Thus, even if the excursion of the vibration is large, the damper 10 does not function as a large load preventing the vibration of the voice coil body 2. Thus, the damper 10 does not prevent the vibration of the voice coil body 2, accordingly allowing the voice coil body 2 to drive the diaphragm 3 efficiently.

In the loudspeaker 1001 according to this embodiment, the voice coil body 2 is supported movably in the direction 1001B by the edge 4 and an assembly 310 including the damper 10 and the edge 11. The edge 4 is thin and has a small weight as to reduce the total weight of the diaphragm 3 and the edge 4. Accordingly, the voice coil body 2 drives the diaphragm 3 efficiently to cause the diaphragm to vibrate.

If being excessively thin, the edge 4 has a small supporting strength for supporting the voice coil body 2. According to the small supporting strength, the edge 11 has a thickness larger than that of the edge 4, preventing the strength for supporting the voice coil body 2 from decreasing. As the result, the assembly 310 including the damper 10 and the edge 11 has Young's modulus larger than that of the edge 4, that is, is stiffer than the edge 4.

As described above, the voice coil body 2 is supported essentially not by the diaphragm 3 but by the assembly 310 including the damper 10 and the edge 11. In order to reduce distortion of the vertical excursion of the diaphragm 3, the load in the direction 1001C caused by the assembly 310 of the damper 10 and the edge 11 is close to the load in the direction 1001D opposite to the direction 1001C caused by the assembly 310, more preferably, is identical to the load in the direction 1001D.

The shapes of the damper 10 and the edge 11 in the loudspeaker 1001 will be described for making the load in the direction 1001C of the assembly 310 identical to the load in the direction 1001D of the assembly 310.

The edge 11 protrudes in the direction 1001D opposite to the direction 1001C directing towards the diaphragm 3, hence deforming in the direction 1001D more easily than in the direction 1001C. The damper 10 absorbs the difference of easiness between the deforming of the edge 11 in the direction 1001C and that in the direction 1001D, as described below.

The damper 10 has the corrugated ring shape. The damper 10 has a cross section along the plane which is parallel to the center axis 1001A and which include the center axis 1001A. The cross section of the damper 10 is corrugated. The cross section of the damper 10 includes protrusions 10A protruding in the direction 1001C towards the diaphragm 3 and protrusions 10B protruding in the direction 1001D opposite to the direction 1001C. The protrusions 10A and the protrusions 10B are located alternately. A protrusion 10C out of protrusions 10A is the closest to the edge 11 among protrusions 10A. A protrusion 10D out of the protrusions 10B is closest to the edge 11 among the protrusions 10B. The protrusion 10D is closer to the edge 11 than the protrusion 10C is. The protrusions 10A include the protrusion 10C and protrusions 10E other than the protrusion 10C. The protrusions 10B include the protrusion 10D and protrusions 10F other than the protrusion 10D. The protrusion 10C has the largest size among the protrusions 10A and 10B, that is, has a size larger than the other protrusions 10D, 10E, and 10F. The protrusion 10D is closer to the edge 11 than the protrusion 10C is. The protrusion 10D is closest to the edge 11 among protrusions 10A and 10B. The protrusion 10C is located more inside than the protrusion 10D, and protrudes in the direction opposite to the direction in which the edge 11 protrudes. The protrusion 10C has the largest size among the other protrusions.

The large protrusion 10C deforms more easily upwardly in the direction 1001C than in the direction 1001D. The edge 11 deforms more easily in the direction 1001D than in the direction 1001C. The size of the protrusion 10C of the damper 10 may be determined appropriately as to allow the assembly 310 including the damper 10 and the edge 11 to deform equally in both the directions 1001C and 1001D. This arrangement allows the diaphragm 3 to vibrate equally in both the directions 1001C and 1001D, accordingly reducing distortion of the vibration. The edge 4 has a weight small enough to allow the loudspeaker 1001 to reproduce middle-frequency and high-frequency sound at high driving efficiency.

The corrugated ring shape of the damper 10 maintains a power linearity until the moving range of the voice coil body 2 exceeds a predetermined range. When the moving range of the voice coil body 2 exceeds the predetermined range and hardly maintains the power linearity, the elasticity of the edge 11 maintains the linearity. Therefore, the edge 11 preferably has Young's modulus larger than that of the damper, i.e., is stiffer than the damper 10.

The damper 10 and the edge 11 preferably have Young's modulus different from each other, and deform independently from each other according to the excursion of the voice coil body 2. A joint portion 320 where the outer rim 210A of the damper 10 is joined to the inner rim 11B of the edge 11 has Young's modulus larger than the damper 10 and the edge 11, i.e., is stiffer than the damper 10 and the edge 11. This structure allows the damper 10 and the edge 11 to operate to deform independently from each other.

The damper 10 and the edge 11 are joined to each other with hard adhesive agent, such as acrylic adhesive, as to allow the joint portion 320 to have Young's modulus larger than that of each of the damper 10 and the edge 11. Alternatively, the damper 10 and the edge 11 may be joined unitarily to each other by an insert molding and provide the joint portion 320 with a large thickness as to allow Young's modulus of the joint portion 320 to be larger than that of each of the damper 10 and the edge 11. Alternatively, a reinforcing component may be attached to the joint portion 320 as to allow Young's modulus of the joint portion 320 to be larger than that of each of the damper 10 and the edge 11.

Figure 3:
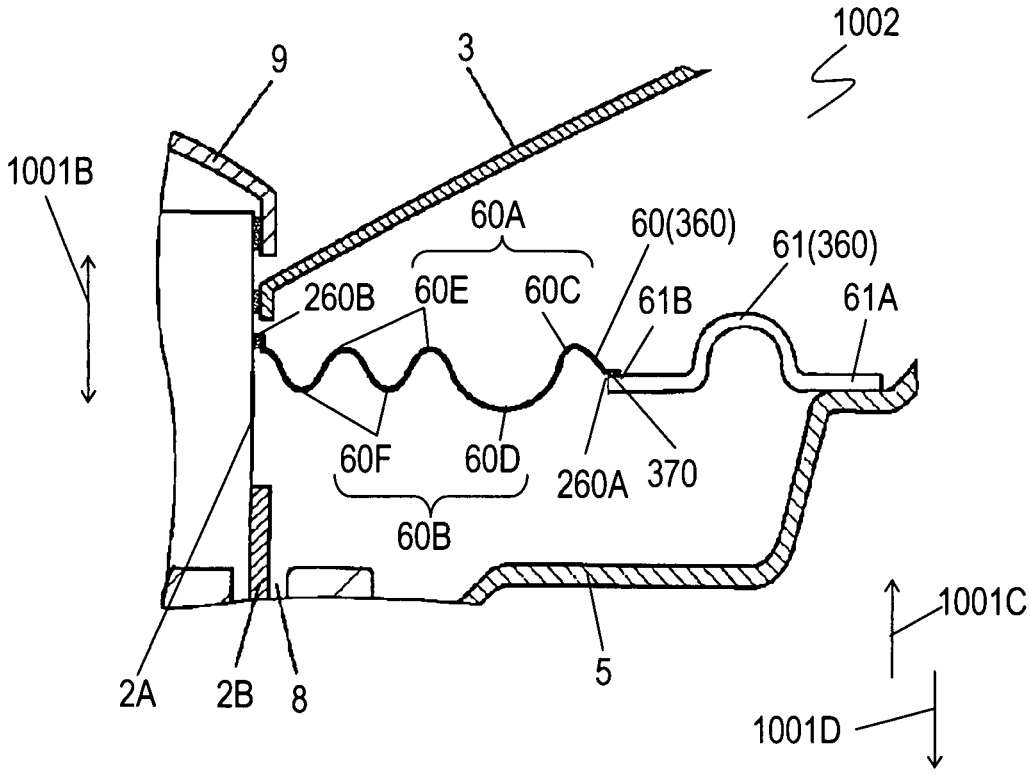
FIG. 3 is an enlarged cross sectional view of another loudspeaker according to embodiment.
Figure 4:
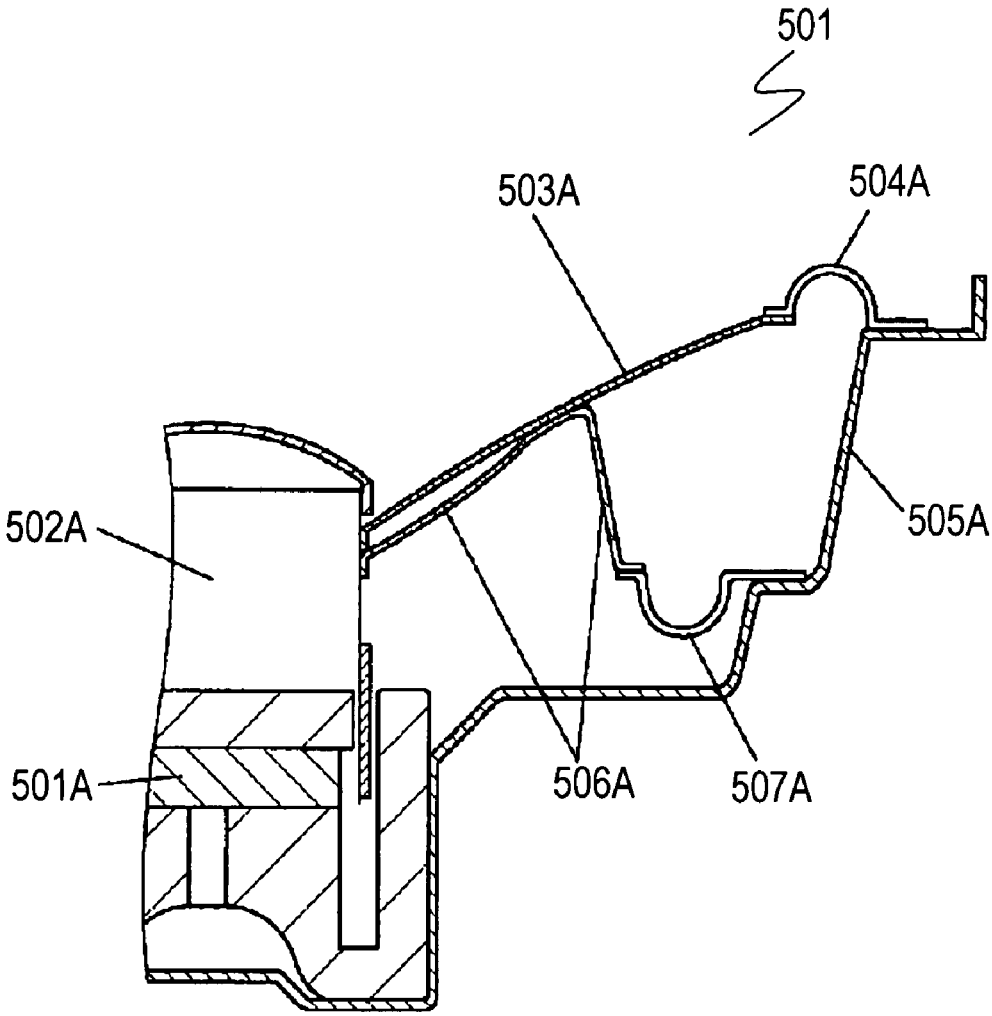
FIG. 4 is a cross sectional view of a conventional loudspeaker.

FIG. 3 is an enlarged cross sectional view of another loudspeaker 1002 according to the embodiment along a plane which is parallel to the center axis 1001A and which includes the center axis 1001A. In FIG. 3, components identical to those of the loudspeaker 1001 shown in FIGS. 1 and 2 are denoted by the same reference numerals, and their description will be omitted. The loudspeaker 1002 includes a damper 60 and an edge 61 instead of the damper 10 and the edge 11 of the loudspeaker 1001, respectively.

The damper 60 has an inner rim 260B joined to the portion 62A of the outer surface 52A of the bobbin 2A of the voice coil body 2. The portion 62A is located in the direction 1001D from the diaphragm 3 towards the magnetic circuit 1. An outer rim 260A of the damper 60 is joined via an edge 61 to the frame 5. More specifically, the outer rim 260A of the damper 60 is joined to the inner rim 61B of the edge 61, and the outer rim 61A of the edge 61 is joined to the frame 5. The edge 61 is a component different from the damper 60. The damper 60 has an corrugated ring shape corrugating radially from the center axis 1001A, hence expanding and contracting according to the excursion of the bobbin 2A of the voice coil body 2. The damper 60, similarly to the edge 4, is made of light material, such as urethane, foamed rubber, SBR rubber, or cloth, which provides the diaphragm 3 with a small moving load.

The edge 61 protrudes in the direction 1001C directing towards the diaphragm 3, and deformed more easily in the direction 1001C than in the direction 1001D. The damper 60 absorbs the difference of easiness between the deforming of the edge 61 in the direction 1001C and that in the direction 1001D, as described below.

The damper 60 has the corrugated ring shape. The damper 60 has a cross section along the plane which is parallel to the center axis 1001A and which includes the center axis 1001A. The cross section of the damper 60 includes protrusions 60A protruding in the direction 1001C directing towards the diaphragm 3 and protrusions 60B protruding in the direction 1001D opposite to the direction 1001C. The protrusions 60A and 60B are alternately located. A protrusion 60C out of the protrusions 60A is closest to the edge 61 among the protrusions 60A. A protrusion 60D out of the protrusions 60B is closest to the edge 61 among the protrusions 60B. The protrusion 60D is closer to the edge 61 than the protrusion 60C is. The protrusions 60A include the protrusion 60C and protrusions 60E other than the protrusion 60C. The protrusions 60B include the protrusion 60D and protrusions 60F other than the protrusion 60D. The size of the protrusion 60D is largest among that of each of the protrusions 60A and 60B, that is, is larger than that of each of the protrusions 60C, 60E, and 60F. The protrusion 60C is closer to the edge 61 than the protrusion 60D is. The projection 60C out of the projections 60A and 60B is closest to the edge 61 among the projections 60A and 60B. The protrusion 60D is located more inside than the projection 60C, and protrudes in the direction opposite to the direction in which the edge 61 projects. The size of the protrusion 60D is largest among that of each of the other protrusions.

The large protrusion 60D deforms upwardly in the direction 1001D more easily than in the direction 1001C. The edge 61 deforms more easily in the direction 1001C than in the direction 1001D. The size of the protrusion 60D of the damper 60 may be determined appropriately as to allow an assembly 360 including the damper 60 and the edge 61 to deform equally in both the directions 1001C and 1001D. This arrangement allows the diaphragm 3 to vibrate equally in both the directions 1001C and 1001D, accordingly reducing distortion of the vibration. The edge 4 has a weight small enough to allow the loudspeaker 1002 to reproduce middle-frequency and high-frequency sound at a high driving efficiency.

The damper 60 and the edge 61 preferably have Young's modulus different from each other, and deform independently from each other according to the excursion of the voice coil body 2. A joint portion 370 where the outer rim 260A of the damper 60 is joined to the inner rim 61B of the edge 61 has Young's modulus larger than the damper 60 and the edge 61, i.e., is stiffer than the damper 60 and the edge 61. This structure allows the damper 60 and the edge 61 to operate to deform independently from each other.

The damper 60 and the edge 61 are joined to each other with hard adhesive agent, such as acrylic adhesive, as to allow the joint portion 370 to have Young's modulus larger than that of each of the damper 60 and the edge 61. Alternatively, the damper 60 and the edge 61 may be joined unitarily to each other by an insert molding and provide the joint portion 370 with a large thickness as to allow Young's modulus of the joint portion 370 to be larger than that of each of the damper 10 and the edge 61. Alternatively, a reinforcing component may be attached to the joint portion 370 as to allow Young's modulus of the joint portion 370 to be larger than that of each of the damper 60 and the edge 61.

INDUSTRIAL APPLICABILITY

A loudspeaker according to the present invention has a small distortion and a large driving efficiency, hence being useful particularly for a loud speaker for reproducing full range sound.

The invention claimed is:

1. A loudspeaker comprising:

a frame;

a magnetic circuit supported by the frame;

a voice coil body provided movably in relation to a magnetic gap provided at the magnetic circuit;

a diaphragm having an inner rim and an outer rim, the outer rim being joined via a first edge to the frame, the inner rim being joined to the voice coil body; and a damper located towards the magnetic circuit from the diaphragm, the damper having an inner rim joined to the voice coil body, wherein the damper has an outer rim joined via a second edge to the frame, the second edge protrudes towards the diaphragm or in a direction opposite to the diaphragm, the damper includes a first protrusion protruding towards the diaphragm and a second protrusion protruding in a direction opposite to a direction in which the first protrusion protrudes, a protrusion out of the first protrusion and the second protrusion is closest to the second edge among the first protrusion and the second protrusion, a further protrusion out of the first protrusion and the second protrusion is located more inside than the protrusion and protrudes in a direction opposite to a direction in which the second edge protrudes, the further protrusion having a size larger than a size of any protrusion out of the first protrusion and the second protrusion other than the further protrusion.

2. The loudspeaker according to claim 1, wherein an assembly including the damper and the second edge has Young's modulus larger than Young's modulus of the first edge.

3. The loudspeaker according to claim 1 or 2, wherein Young's modulus of the second edge is larger than Young's modulus of the damper.

4. The loudspeaker according to claim 3, wherein Young's modulus of a joint portion where the damper and the second edge are joined is larger than Young's modulus of each of the damper and the second edge.

5. The loudspeaker according to claim 1, wherein the second edge is a component different from the damper.

6. The loudspeaker according to claim 1, wherein Young's modulus of a joint portion where the damper and the second edge are joined is larger than Young's modulus of each of the damper and the second edge.

7. The loudspeaker according to claim 2, wherein Young's modulus of a joint portion where the damper and the second edge are joined is larger than Young's modulus of each of the damper and the second edge.

* * * * *